US009976289B2

(12) United States Patent
Haun, Sr.

(10) Patent No.: US 9,976,289 B2
(45) Date of Patent: May 22, 2018

(54) PIPE FREEZE-PREVENTION SYSTEM

(71) Applicant: Robert Vernon Haun, Sr., Centerville, PA (US)

(72) Inventor: Robert Vernon Haun, Sr., Centerville, PA (US)

( * ) Notice: Subject to any disclaimer, the term of this patent is extended or adjusted under 35 U.S.C. 154(b) by 0 days. days.

(21) Appl. No.: 14/837,416

(22) Filed: Aug. 27, 2015

(65) Prior Publication Data

US 2017/0058494 A1 Mar. 2, 2017

(51) Int. Cl.
*E03B 7/12* (2006.01)

(52) U.S. Cl.
CPC ..... *E03B 7/12* (2013.01); *Y10T 137/1963* (2015.04); *Y10T 137/1987* (2015.04)

(58) Field of Classification Search
CPC ..... E03B 7/12; E03B 7/10; Y10T 137/1963; Y10T 137/1939; Y10T 137/1987; Y10T 137/86389; Y10T 137/86405; Y10T 137/86413; Y10T 137/86421; Y10T 137/86429; Y10T 137/86445; Y10T 137/86453; Y10T 137/86461; Y10T 137/86469; Y10T 137/1189; Y10T 137/1244; Y10T 137/1298; Y10T 137/1353
USPC ..... 251/129.01, 129.03, 129.04, 129.05, 251/129.15–129.22
See application file for complete search history.

(56) References Cited

U.S. PATENT DOCUMENTS 1,226,696 A * 5/1917 Ramseur ..... H02P 7/03 137/59
2,271,833 A * 2/1942 Shipman ..... G05D 23/125 137/627.5
2,775,291 A * 12/1956 Wilson ..... F23N 5/123 361/163
2,962,610 A * 11/1960 Husband ..... G04F 3/06 137/624.11
2,991,938 A * 7/1961 Norcross ..... A01G 25/167 137/78.2
3,590,335 A * 6/1971 Tetar ..... G05D 27/02 239/64
4,023,585 A * 5/1977 VandenBurg ..... A01G 13/06 137/624.12
4,029,918 A * 6/1977 Kah, Jr. ..... A01G 25/162 200/38 CA
4,061,927 A * 12/1977 Link ..... A01G 25/162 307/41
4,101,786 A * 7/1978 Ruggles ..... A01G 25/162 137/624.2

(Continued)

OTHER PUBLICATIONS

"The $3 Sprinkler Timer" published online by "Hackers Bench" (http://hackersbench.com/Projects/3bucktimer/) on Jun. 2007 (pp. 1-5).*

*Primary Examiner* — Reinaldo Sanchez-Medina
*Assistant Examiner* — David Colon Morales
(74) *Attorney, Agent, or Firm* — Richard K. Thomson

(57) ABSTRACT

A system for reducing the risk of waterlines freezing provides a solenoid controlled valve which may be cycled twice an hour for a minute (or longer if desired) to avoid ice buildup in the lines. The control circuit allows the homeowner flexibility in determining whether to allow the cycle timers (preferably 3 inexpensive timers) to control the solenoid valve's cycling directly or to permit a thermostat to intervene, cycling only when the set point of the thermostat is reached.

7 Claims, 1 Drawing Sheet

(56) References Cited

U.S. PATENT DOCUMENTS 4,121,114 A * 10/1978 Ruggles ..... G05B 19/07 137/624.2
4,165,532 A * 8/1979 Kendall ..... A01G 25/16 137/624.2
4,232,707 A * 11/1980 Sturman ..... A01G 25/162 137/624.2
4,244,022 A * 1/1981 Kendall ..... G04G 15/006 137/624.2
4,333,490 A * 6/1982 Enter, Sr. ..... A01G 25/16 137/624.11
4,569,020 A * 2/1986 Snoddy ..... A01G 25/16 137/624.2
4,635,668 A * 1/1987 Netter ..... E03B 7/12 137/392
4,657,038 A * 4/1987 Lyons ..... E03B 7/12 137/62
4,661,719 A * 4/1987 Burchfiel ..... A01G 25/165 137/624.11
4,779,839 A * 10/1988 Sears ..... F16K 31/02 251/129.04
4,796,654 A * 1/1989 Simpson ..... A01G 25/167 137/624.11
4,911,200 A * 3/1990 Ben-Arie ..... G01M 3/2807 137/486
4,921,001 A * 5/1990 Pittsinger ..... A01G 25/16 137/624.12
5,004,012 A * 4/1991 Bratten ..... E03B 7/10 137/560
5,056,554 A * 10/1991 White ..... E03B 7/12 137/312
5,113,892 A * 5/1992 Hull ..... E03B 7/10 137/238
5,148,826 A * 9/1992 Bakhshaei ..... A01G 25/167 137/78.3
5,154,349 A * 10/1992 Vaughn ..... A01G 25/16 137/624.2
5,220,937 A * 6/1993 Roberts ..... E03B 7/12 122/504
5,287,888 A * 2/1994 Geiger ..... A01G 25/162 137/624.2
5,638,847 A * 6/1997 Hoch, Jr. ..... E03B 7/10 137/312
5,694,963 A * 12/1997 Fredell ..... E03B 7/12 137/2
5,813,363 A * 9/1998 Snelling ..... A01K 7/027 119/73
6,021,798 A * 2/2000 Martin ..... E03B 7/10 137/59
6,105,607 A * 8/2000 Caise ..... F16K 31/402 137/487.5
6,125,873 A * 10/2000 Brown ..... E03B 7/12 137/62
6,142,170 A * 11/2000 Belfer ..... A61C 1/0076 134/102.2
6,439,260 B1 * 8/2002 Shuff ..... E03B 7/12 137/312
6,647,319 B1 * 11/2003 Goldberg ..... A01G 25/165 239/69
6,691,724 B2 * 2/2004 Ford ..... E03B 7/071 137/1
6,763,845 B2 * 7/2004 Hoggard ..... E03B 7/10 137/434
6,860,288 B2 * 3/2005 Uhler ..... F17D 5/06 137/312
6,892,751 B2 * 5/2005 Sanders ..... E03B 7/071 137/312
2011/0233290 A1 * 9/2011 Borovinov ..... F24D 19/1012 236/93 R
2012/0097253 A1 * 4/2012 Eutsler ..... F16K 31/025 137/1
2013/0025709 A1 * 1/2013 Mann ..... E03B 7/10 137/468
2014/0000724 A1 * 1/2014 Park ..... E03B 7/08 137/78.1
2014/0238511 A1 * 8/2014 Klicpera ..... E03B 7/071 137/551
2014/0261693 A1 * 9/2014 Geerligs ..... E03B 7/12 137/1

* cited by examiner

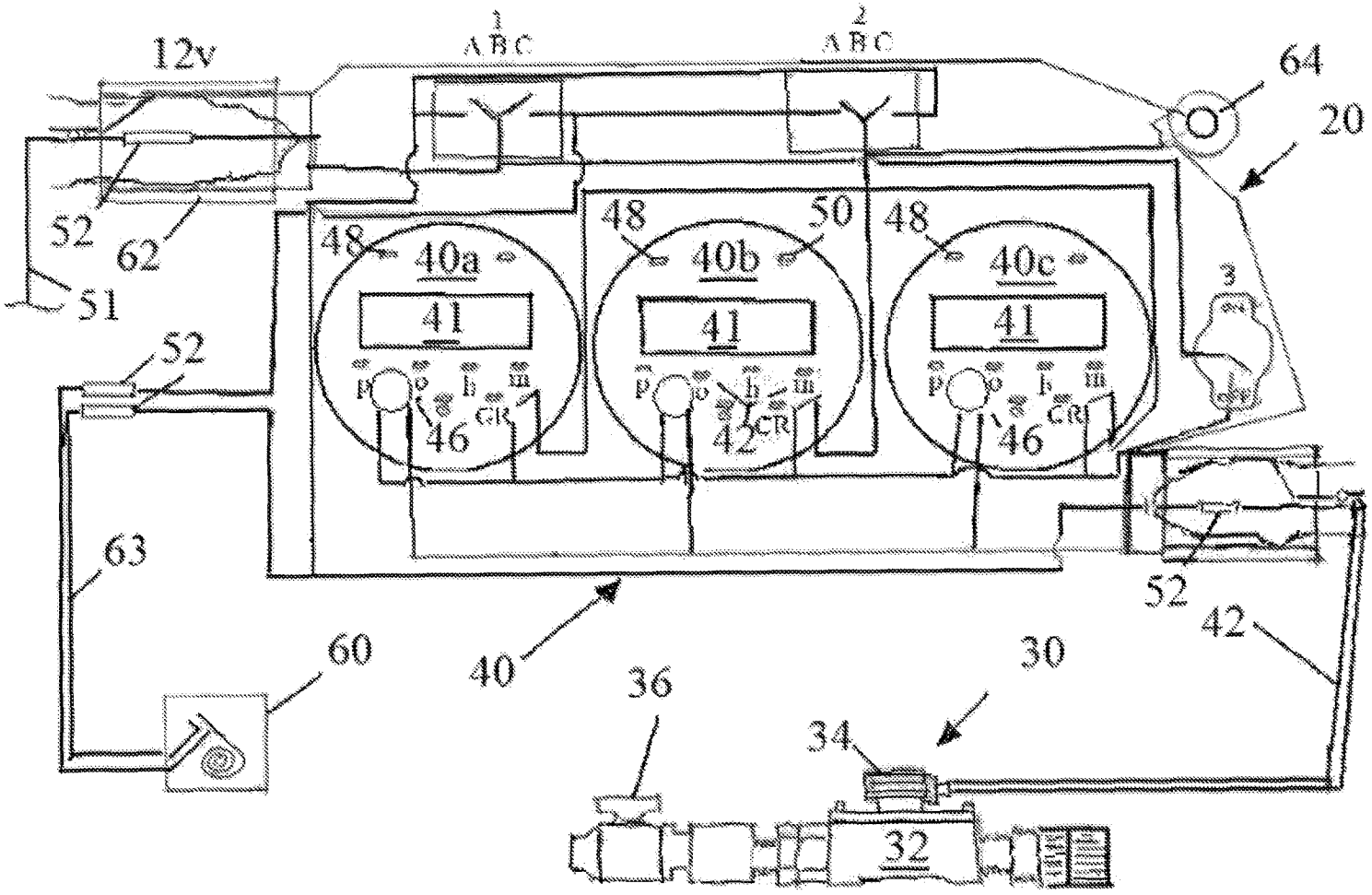
20
64
3
42
52
30
32
34
36
40
40a
40b
40c
41
46
48
50
60
63
62
12v
51
52
1
ABC
2
ABC

PIPE FREEZE-PREVENTION SYSTEM

BACKGROUND AND SUMMARY OF THE INVENTION

The present invention is directed to the field of home maintenance. More particularly, the present invention is directed to a system for reducing the risk of the freezing of water lines.

Thousands of homeowners each year endure the hassle and inconvenience of waterlines freezing in their homes. This is a major investment of time and money to replace cracked/split pipes and to repair/replace water valves, toilet bowls, sinks, and other fixtures, to say nothing of the repair of damage done by the water that is released inside the home by the fractured pipes/valves, etc.

The present invention provides a system which allows a solenoid-operated valve to be placed in the waterline and at least one, (preferably several) timers to be programmed to automatically vent the waterline periodically. For example, the timers can be programmed to allow the solenoid-operated valve to kick on every half hour for one minute. This periodic and systematic flow of water through the pipes prevents ice buildup and significantly reduces the risk associated with waterline freeze.

The present invention includes apparatus for reducing a risk of water pipes freezing, the apparatus comprising: a) a control valve assembly including a solenoid-operated valve which has both a valve and a solenoid, the control valve adapted for attachment in a waterline; b) an electrical control circuit for energizing the solenoid, the control circuit including i) a first electrical switch to activate the solenoid-operated valve; ii) at least one cycle timer optionally associated with the solenoid for operating the solenoid to open the valve allowing water to flow through the waterline for a set period of time preventing ice buildup within the waterline; iii) a thermostat optionally connectable in the control circuit to activate said control valve when an atmospheric temperature drops below a set level.

The apparatus further includes an electrical system for operating the at least one cycle timer and the associated control valve. More preferably, the at least one cycle timer includes a plurality of cycle timers, that plurality most preferably equaling 3. It is preferred that each of the cycle timers includes programmable circuitry for adjusting its operation. The circuitry includes means to permit adjustment of both a frequency and a duration of operation of the cycle timer. Further, the circuitry includes a backup battery for the at least one cycle timer to maintain input programming information. More preferably, an individual backup battery for each of the plurality of cycle timers is provided. A valve assembly includes a manually adjustable valve to control the amount of water released by the solenoid operated valve.

Various other features, advantages, and characteristics of the present invention will become apparent after a reading of the following detailed description.

BRIEF DESCRIPTION OF THE DRAWINGS

The preferred embodiment the system for preventing freezing of waterlines of the present invention is described in conjunction with the associated drawing in which like features are indicated with like reference numerals and in which FIG. 1 is a circuit diagram of the inventive system.

DETAILED DESCRIPTION OF THE PREFERRED EMBODIMENT(S)

A first embodiment of the pipe freeze-prevention (PFP) system of the present invention is depicted in FIG. 1 generally at 20. PFP system 20 includes a control valve assembly 30; a control circuit 40 which may optionally include thermostat 60. It is envisioned that the installation kit provided for the DIY installer would offer, at least as an option, adequate electrical cord 42 for connecting cycle timers 40*a*, 40*b*, 40*c* to control valve assembly 30 (say 50 ft), 51 for connection to control circuit 40 and 63 for the thermostat 60 to allow the various elements to be positioned in accordance with the specific needs/layout of the residence. Further, it will be understood that while the configuration shown contemplates installing PFP system 20 in the cold water line, the incorporation of a pair of Y-connector splitters to, for example, the hot and cold water lines of the clothes washer, could easily adapt a single PFP system 20 to protect both the hot and cold water lines of a residence.

As seen in FIG. 1, the PFP system 20 employs three cycle timers 40*a*, 40*b*, 40*c*. The hardware selected for cycle timers 40*a*, 40*b*, and 40*c* is relatively inexpensive ≤$20 each) and is capable of up to 17 separate inputs or programmed cycles. Hence, by utilizing 3 timers, each programmed to cycle 16 times, a system capable of cycling twice an hour for 24 hours (or 48 times a day), can be provided. A cycle timer capable of 80 separate set points is commercially available ≥$300); however, although it is within the scope of the present invention to incorporate the more costly cycle timer, it was felt that providing such capability was overkill and would price the device out of the reach of most DIY installers, both home owners and small businesses alike.

The control valve assembly 30 includes a valve 32 and a solenoid 34 operatively connected to valve 32. Threaded attachment 35 allows control valve assembly 30 to be attached to any waterline, such as a wash basin spigot, cold/hot water line for clothes washer, etc. A manually operated valve 36 is in line with the valve assembly 30 and permits the amount of water discharged during the protective cycles to be adjusted. A large indicator light 64 is illuminated when the system is powered up. Light 64 draws enough current to ensure that the electronic cycle timers do not reset losing all the programmed data.

Cycle timers 40*a*, 40*b*, 40*c* each have digital display window 41, a plurality of programming buttons 42, a backup battery behind removable panel 46, a lamp 48 showing which cycle timer is operating, and a button 50 for switching from automatic to manual operation. A plurality of 2 amp fuses 52 protect the circuitry from power surges. A connector 62 for 12 v battery (not shown) provides up to 10 days of emergency power for the system, should a power outage occurs. If the power is out for longer periods of time than 10 days, there will doubtless be more significant problems lurking than freezing pipes. Normal power is provided from a trickle charger (not shown) from a 115 v wall socket.

Three switches 1, 2, 3 in control circuit 40 provide options to the homeowner. With switch 3 turned off, for a control valve test, switch 1 will be set in the 'C' position and switch 2 in the 'B' position. To allow the thermostat 60 to control operation, switch 3 remains off, switch 1 to 'A' position, switch 2 to 'B' position. To allow the cycle timer to control without intervention of the thermostat 60, switch positions are switch 1 'B', switch 2 'A' and 3 is 'on'. For cycle timer to have thermostatic control, switch 1 is in the 'B' position, switch 2 in the 'C' position and switch 3 is 'on'. This last configuration would be the most frequently used by the majority of homeowners. Lamp 64 indicates when the cycle timers 40*a* 40*b*, and 40*c* are energized. Further, if for some reason the solenoid-controlled valve is not functioning, lamp 64 draws enough power to keep cycle timers 40*a* 40*b*, and 40*c* from losing their programmed information.

The pipe freeze-prevention system 20 of the present invention allows a home or business owner great flexibility in set up to provide cycling at up to 48 times per day for whatever period of time s/he regards as prudent to reduce the risk of ice buildup in the waterline. Most users will take advantage of the thermostat 60 to energize the cycle timers 40*a* 40*b*, and 40*c* when the weather dictates. However, if the home or business owner prefers, s/he may allow the cycle timers 40*a* 40*b*, and 40*c* to operate solenoid valve 30 in accordance with the program s/he determines, cycling as often as s/he wants (up to 48 times a day) for whatever period of time desired. Further, the amount of water flowing can be manually adjusted using valve 36. Lastly, the thermostat can be set to whatever level appropriate for its positioning in the owner's establishment. For example, if the thermostat 60 is positioned outside the residence, and the home/business owner is aware that when the outside temperature reaches say, for example, 28°, his waterlines are at risk to freeze, then s/he may set the thermostat 60 to kick the power on at 28° or higher, if desired.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. Apparatus for reducing a risk of water pipes freezing, said apparatus comprising:

a) a control valve assembly including a solenoid-operated valve having both a valve and a solenoid, said control valve adapted for attachment in a waterline;

b) an electrical control circuit for energizing said solenoid to cycle said control valve assembly on and off multiple times per day up to 48 times per day, said control circuit including i) a first electrical switch to activate said solenoid-operated valve;

ii) a plurality of cycle timers associated with said solenoid for sequentially operating said solenoid to open said valve allowing water to flow through the waterline for a set period of time on the order of one minute preventing ice buildup within the waterline, said cycle timer having adjustment means permitting a homeowner to preset how many times per day and on what time cycle said solenoid activates said valve;

iii) a thermostat connectable in said control circuit to activate said control valve when an atmospheric temperature drops below a set level;

iv) an electrical system for operating said plurality of cycle timers and said control valve.

2. The apparatus of claim 1 wherein said plurality of cycle timers is 3.

3. The apparatus of claim 2 wherein each of said cycle timers includes programmable circuitry for adjusting its operation.

4. The apparatus of claim 3 wherein said programmable circuitry includes means to permit adjustment of both a frequency and a duration of operation of said cycle timer.

5. The apparatus of claim 3 further comprising a backup battery for said at least one cycle timer to maintain input programming information.

6. The apparatus of claim 5 further comprising an individual backup battery for each of said plurality of cycle timers.

7. The apparatus of claim 1 further comprising a manually adjustable valve to control an amount of water released by said solenoid operated valve.

* * * * *